United States Patent [19]

Waris

[11] Patent Number: 4,557,802

[45] Date of Patent: Dec. 10, 1985

[54] APPARATUS FOR AFFECTING A WEB DRAINED ON A WIRE

[75] Inventor: Veikko K. T. Waris, Kyminlinna, Finland

[73] Assignee: A. Ahlstrom Osakeyhtio, Noormarkku, Finland

[21] Appl. No.: 523,658

[22] Filed: Aug. 15, 1983

[30] Foreign Application Priority Data

Aug. 23, 1982 [FI] Finland ..... 822917

[51] Int. Cl.[4] ..... D21F 1/66

[52] U.S. Cl. ..... 162/264; 162/301; 162/308; 162/312

[58] Field of Search ..... 162/190, 264, 303, 305, 162/308, 312, 351, 354, 358, 363, DIG. 7, 301

[56] References Cited

U.S. PATENT DOCUMENTS 2,881,673 4/1959 Sheldon ..... 162/351

3,232,825 2/1966 Robinson ..... 162/363

3,403,073 9/1968 Moran ..... 162/DIG. 7

FOREIGN PATENT DOCUMENTS 780587 8/1957 United Kingdom ..... 162/DIG. 7

*Primary Examiner*—Peter Chin

*Attorney, Agent, or Firm*—Bucknam and Archer

[57] ABSTRACT

An apparatus for affecting a web drained on a wire, comprising a lower wire which runs as an endless loop; disposed transverse members which supporting the lower wire, disposed at a distance from each other; an upper wire which runs as an endless loop and presses the web formed on the lower wire in the area between the supporting members. Inside the upper wire loop there is disposed a dewatering shoe which is in contact with the upper wire, and a roll which together with the dewatering shoe form a flow channel for leading upwards the water pressed out.

7 Claims, 8 Drawing Figures

APPARATUS FOR AFFECTING A WEB DRAINED ON A WIRE

The invention relates to an apparatus for affecting a web which has drained on a wire, comprising a lower forming wire running in an endless loop, at a distance from each other disposed transverse members which support the lower wire, and an upper forming wire running in an endless loop and pressing the web formed on the lower wire.

In similar dewatering devices disposed on the wire the main problem is how to remove from the wire the upwardly removed water. In known devices of this kind this is done either by using a separate suction system by means of which the water is lifted to suction boxes, as is disclosed e.g. in CA Pat. No. 1,057,546, or by leading the wire in a curved path so low that a space is formed behind the dewatering section, whereto the water is slung due to gravitation. The disadvantages of these systems are:

- the suction system requires suction capacity and control of the suction
- the downwardly curved path of the wire causes expensive structural alterations in case the dewatering devices are installed in existing machines.

The essential feature in the solution according to the invention is a rotating roll which together with a stationary structure forms a narrow dewatering channel. The rotational movement of the roll causes the water to move in the narrow channel (1 to 20 mm) along with the roll and to flow to a chamber above the wire, wherefrom it can easily be removed through the ends of the chamber. The size of the channel and the velocity of rotation of the roll which both can both be adjusted, affect the dewatering process.

The surface of the roll is preferably smooth, but it can also be grooved or provided with internal dewatering channels.

The apparatus is primarily intended for fourdrinier paper machines.

The apparatus can be applied to existing machines in which the dewatering capacity is to be increased and in which the web is to be affected by subjecting it to surface pressure and upward dewatering in the wire section but, of course, also to new machines, whereby the structure of the dewatering section becomes short and compact.

The apparatus in accordance with the invention is characterized in that inside the upper wire loop there is a dewatering shoe which is in contact with the upper wire and a roll which together with the dewatering shoe forms a flow passage for leading upwards the water that has been pressed out.

The invention will be described more fully in the following with reference to the accompanying drawings. In the drawings:

FIG. 5 illustrates the internal dewatering channels of the roll.

Figure 1:
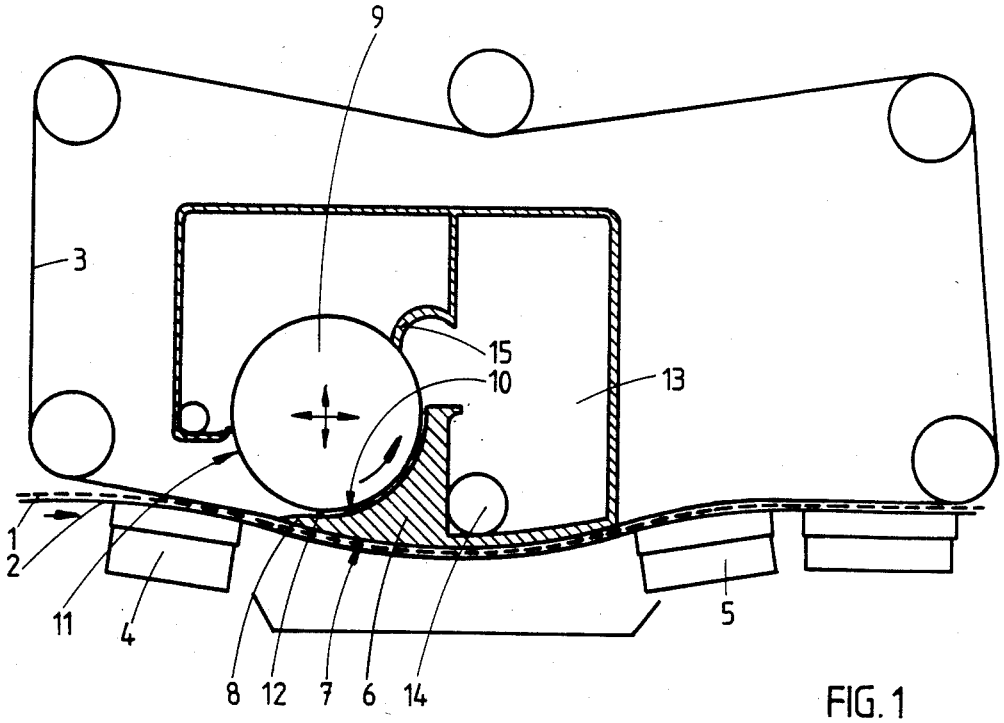
FIG. 1 is a schematic side view, partly in section, of an embodiment according to the invention.

FIG. 5*a* is a cross-section.

FIG. 6 illustrates the roll with grooves.

FIG. 6*a* is a cross-section.

A web 1, e.g. a paper web, is formed in a manner known per se on a wire 2. The wire runs as an endless loop (only partially shown) from the headbox to the press section as a mainly horizontal fourdrinier wire. On the wire 2 there is disposed another wire 3 running as an endless loop. The lower wire is led over two transverse supporting members 4 and 5 disposed at a distance from each other. Between them the wire is not supported. Between the supporting members the wire can be pressed more or less forcibly against the web on the lower forming wire by means of a dewatering shoe 6 disposed inside the upper wire loop. The lower surface 7 of the dewatering shoe 6 is curved so that the wires and the web between them curve downwards. The tip 8 of the dewatering shoe is wedge-shaped and acts as a water box doctor sweeping water from the upper surface of the wire and removing it. Inside the upper wire there is also disposed a rotating roll 9, the rotational velocity of which can be adjusted so that the peripheral velocity is as high as the velocity of the wire or differs therefrom. The roll is disposed in the dewatering shoe so that a surface 10 of the dewatering shoe and a mantel surface 11 of the roll form a channel 12 which, seen in the direction of rotation of the roll, leads away from the upper wire. The height of the channel between the roll and the dewatering shoe can be adjusted by moving the roll in a manner known per se. When rotating, the roll conveys in front of it the water which has been pressed out to a water box 13 behind it, wherefrom the water is removed through a discharge opening 14. Water is removed from the surface of the roll by means of a doctor blade 15.

In the figure, the supporting member 4 is a stationary, curved and smooth shoe, but it can be substituted by a smooth, grooved, blind-bored or perforated roll. The upper wire comes to contact with the wire on the shoe 4.

The supporting member 5 is a curved, stationary and smooth shoe, but it can be substituted by a roll or a suction box.

Figure 2:
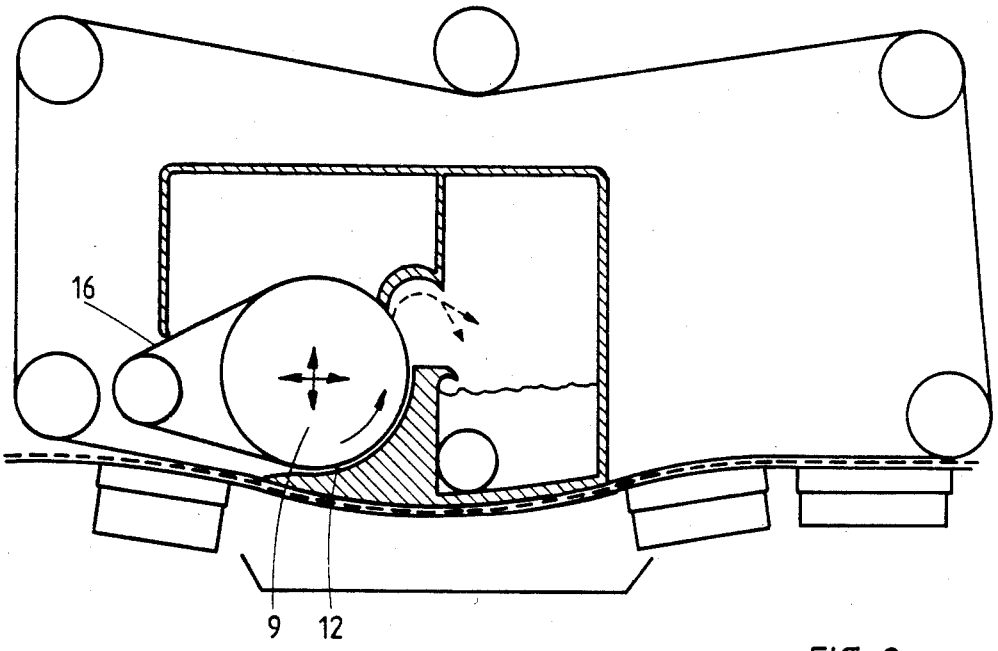
FIG. 2 shows another embodiment of the invention.

The alternative embodiment illustrated in FIG. 1 differs from the one shown in FIG. 2 mainly in that a wire or some other endless belt 16 runs around the roll 9. By changing the belt to a belt of another kind, it is easy to change the structure of the movable restriction surface of the flow channel 12.

Figure 3:
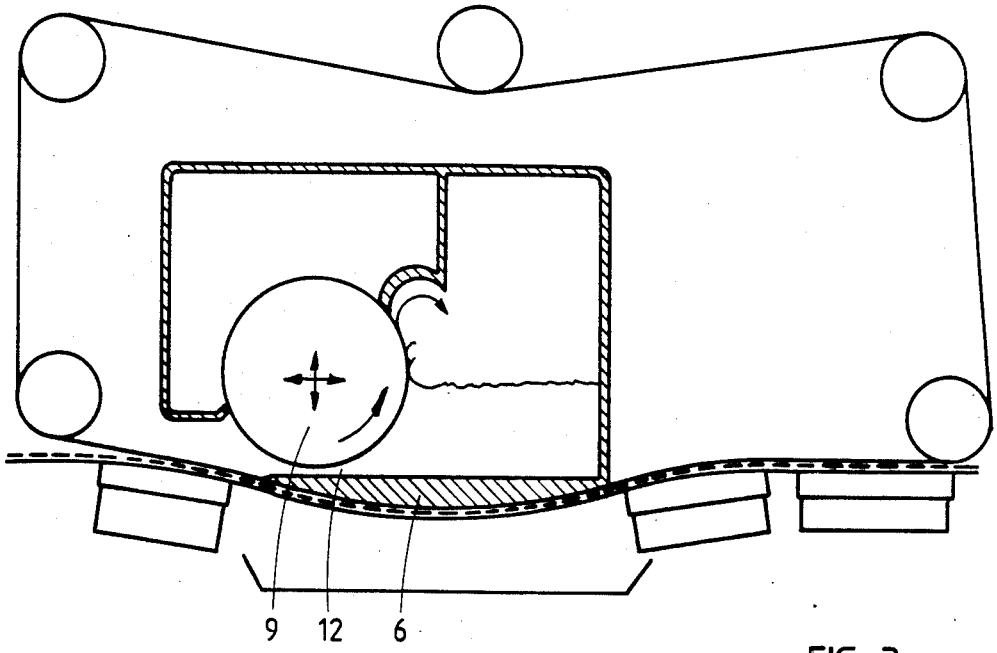
FIG. 3 shows a third embodiment of the invention.

In the embodiment illustrated in FIG. 3 the roll 9 and the dewatering shoe 6 form a convergent and divergent flow channel 12 between them. The narrowest point of the channel determines the dewatering capacity of the device.

Figure 4:
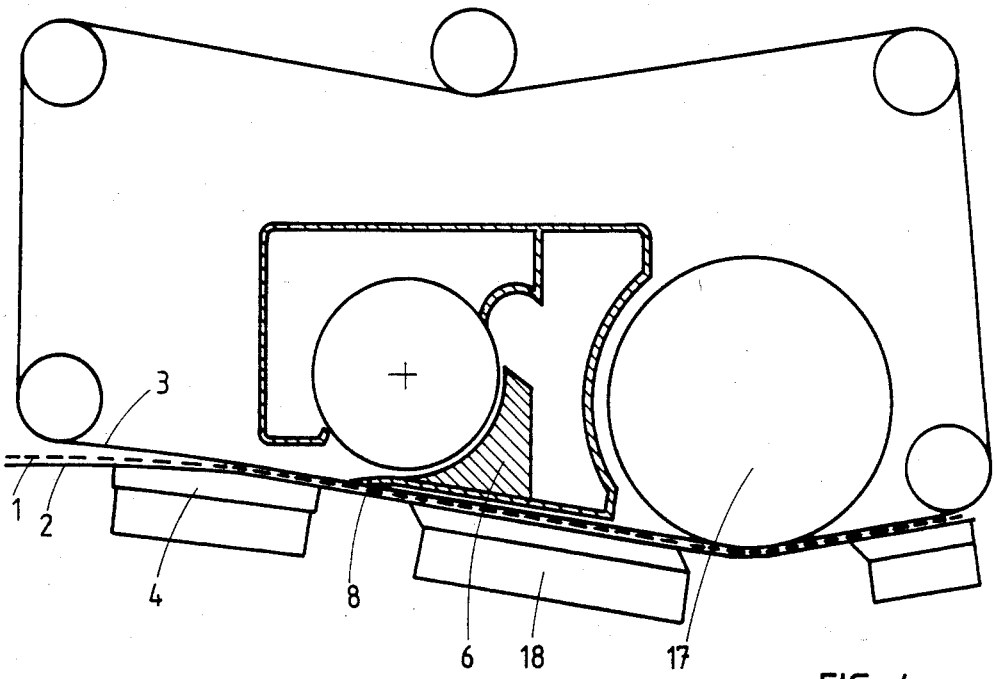
FIG. 4 shows still another embodiment of the invention.

In the embodiment shown in FIG. 4, the upper wire 3 is pressed against the web on the lower wire 2 by means of a roll 17. In the area between the supporting member 4 and the roll 17 the wires and the web between them run obliquely downwards. Only the tip 8 of the dewatering shoe 6 is in contact with the upper wire. A suction box 18 is disposed below the lower wire. The upward dewatering is carried out in the same way as in the embodiments described above.

The specific embodiments shown are not meant to limit the invention, but numerous modifications may be effected without departing from the scope of the claims.

I claim:

1. An apparatus for affecting the draining of a web comprising a lower wire (2) running as an endless loop and supporting the web; at least two members (4,5)

disposed at a distance from each other supporting said lower wire; an upper wire (3) running as an endless loop, said upper wire being pressed on the web supported on the lower wire in the area between said at least two members; a dewatering shoe (6) disposed within said upper wire loop, said shoe having a convex curved lower surface and a concave curved upper surface joined at one end to form a wedge-shaped tip, the lower surface being in contact with the upper wire, whereby the web, the upper wire and the lower wire curve downwardly, a first roll disposed out of contact with the upper wire and above said upper curved concave surface of the dewatering shoe, said wedge-shaped tip being positioned under the first half of the roll, said wedge-shaped tip acting as a water doctor in contact with the upper wire, means for controlling the speed of said first roll independently of the speed of the upper wire, said roll together with the upper surface of the dewatering shoe forming a narrow flow channel (12) of essentially constant height for leading upwards the water which has been pressed out.

2. An apparatus as defined in claim 1 wherein a doctor blade is arranged in contact with the upper portion of the first roll for removing water from the surface of the roll after the flow channel.

3. An apparatus as defined in claim 1 additionally comprising an endless belt 16 disposed around said first roll and an auxiliary roll, said auxiliary roll being located within said upper wire loop and on the side opposite to said dewatering shoe.

4. The apparatus according to claim 1 wherein said members disposed at a distance from each other are two transverse members.

5. The apparatus according to claim 1 wherein one of said members disposed at a distance from each other is a transverse member and the other member is a second roll (17) located downstream of said dewatering shoe and the web, the upper wire and the lower wire run downwardly between said transverse member and said second roll.

6. The apparatus according to claim 5 which comprises a suction box located below the lower wire in the zone between said transverse member and said second roll.

7. The apparatus according to claim 1 wherein the surface of said roll is smooth.

* * * * *